US005248001A

United States Patent [19]

Moseley

[11] Patent Number: 5,248,001

[45] Date of Patent: Sep. 28, 1993

[54] TRACTOR-MOUNTED MACHINE AND METHOD FOR DRIVING STEEL POSTS

[76] Inventor: David L. Moseley, 14128 Apple Tree La., Houston, Tex. 77079

[21] Appl. No.: 841,065

[22] Filed: Feb. 25, 1992

[51] Int. Cl.[5] ..... E02D 7/06

[52] U.S. Cl. ..... 173/1; 173/26; 173/120; 173/124; 173/185

[58] Field of Search ..... 173/26, 28, 25, 124, 173/122, 205, 120, 185, 187, 1, 184

[56] References Cited

U.S. PATENT DOCUMENTS

| | | | |
|---|---|---|---|
| 1,944,572 | 1/1934 | Rawlings | 173/120 |
| 2,410,508 | 11/1946 | Lamme | 173/26 |
| 2,659,584 | 11/1953 | Dorkins | 173/28 |
| 2,792,689 | 5/1957 | Phares | 173/124 |
| 3,447,613 | 6/1969 | Lisenby | 173/28 |
| 3,605,912 | 9/1971 | Fisher | 173/28 |
| 4,002,210 | 1/1977 | White | 173/26 |
| 4,050,526 | 9/1977 | Deike | 173/28 |
| 4,732,220 | 3/1988 | Johnsson | 173/124 |

*Primary Examiner*—Scott Smith

*Attorney, Agent, or Firm*—Bush, Moseley & Riddle

[57] ABSTRACT

In accordance with an illustrative embodiment of the present invention, a steel post driving machine that is mounted on the lift mechanism of a tractor includes a mast having a tubular hammer slidably guided thereon, springs to accelerate the hammer downward, a cable to lift the hammer and lengthen the springs to store potential energy therein, and a mechanism coupled to the cable and powered by the PTO of the tractor for intermittently pulling on and then releasing the cable to cause the hammer to strike repeated impact blows on the top of the steel post. Upper and lower devices are included to maintain the mast in alignment with the post as the lift mechanism is being lowered and the post is being driven into the ground by the hammer.

30 Claims, 3 Drawing Sheets

FIG.1
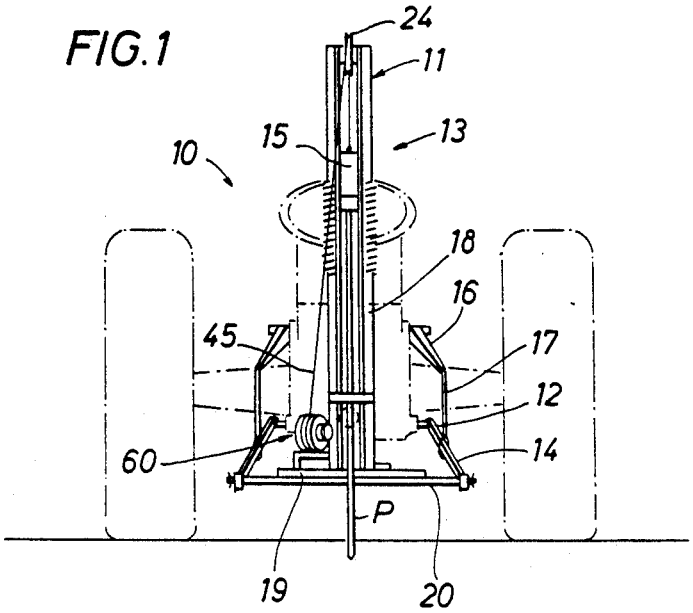
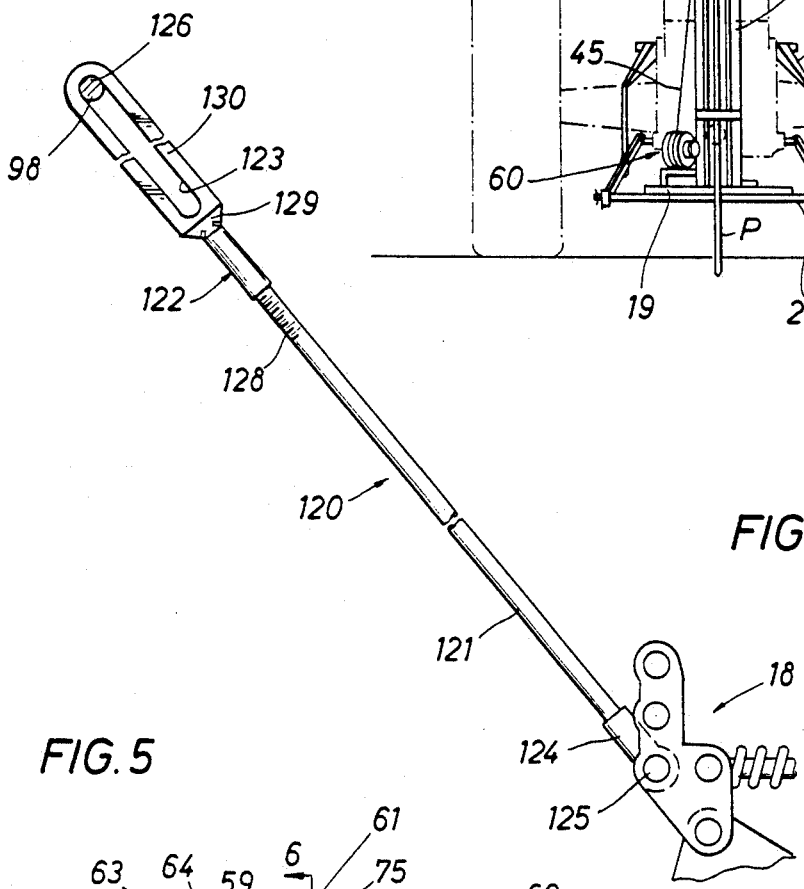
FIG.4
FIG.5
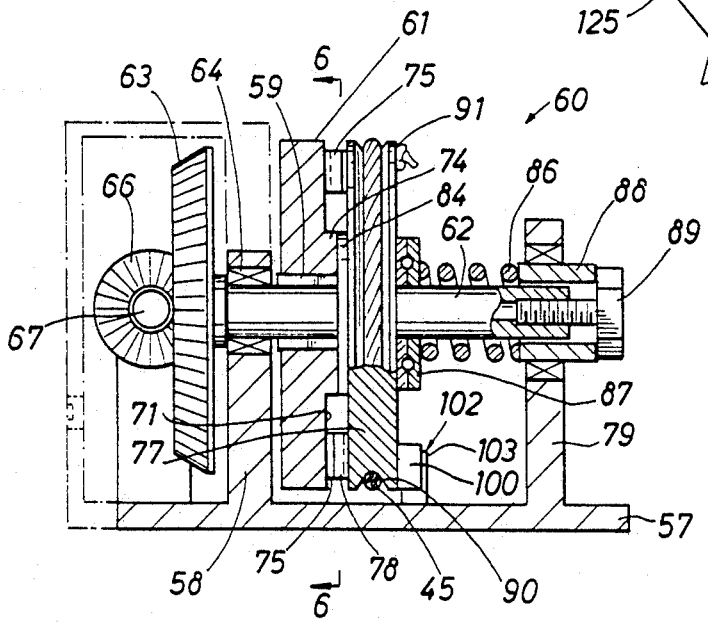
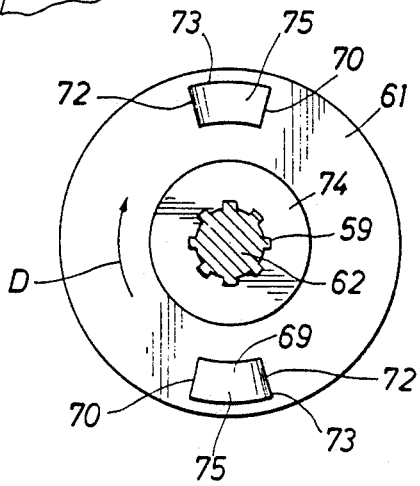
FIG.6

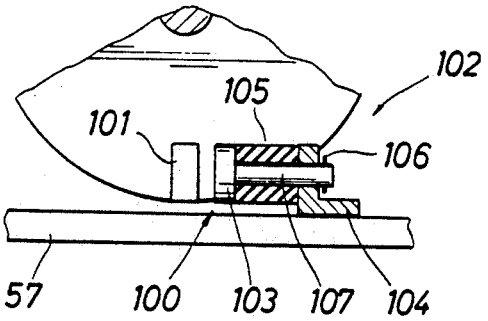
FIG. 7
FIG. 8A
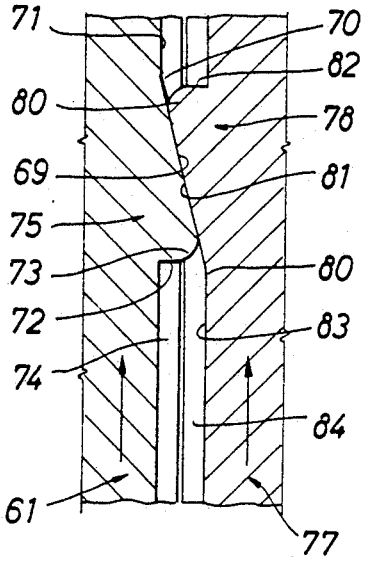
FIG. 8B
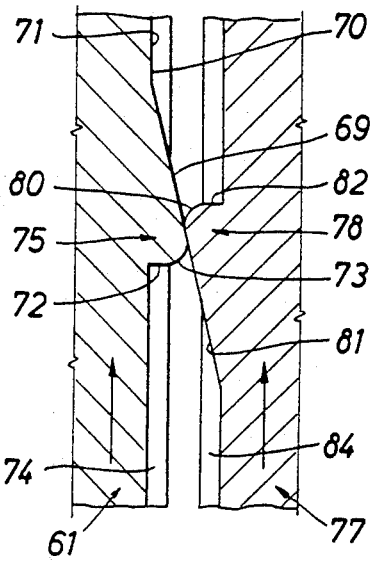
FIG. 8C
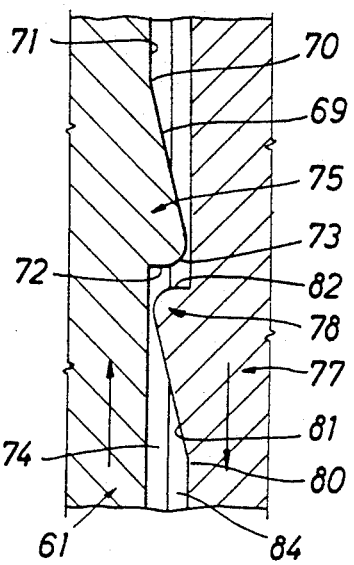
FIG. 9
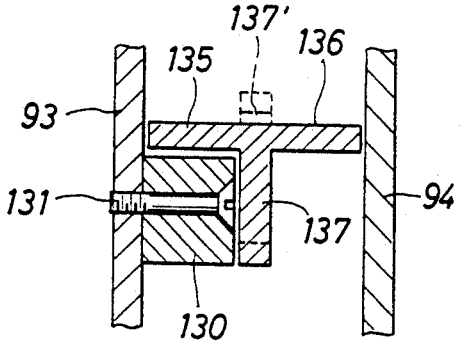
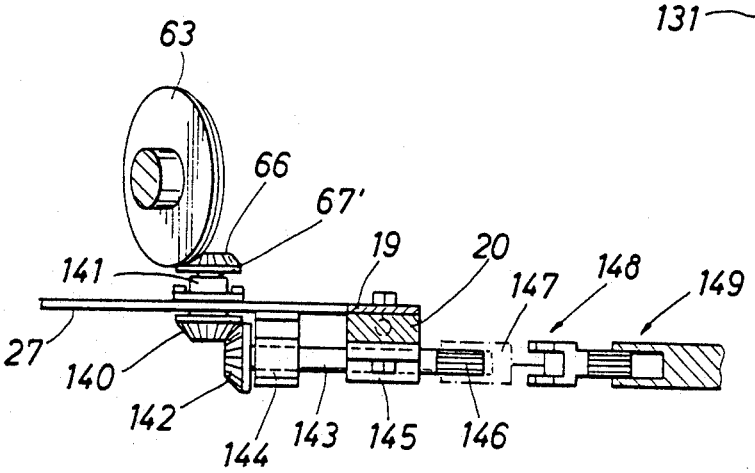
FIG. 10

TRACTOR-MOUNTED MACHINE AND METHOD FOR DRIVING STEEL POSTS

FIELD OF THE INVENTION

This invention relates generally to a machine for use in driving elongated slender metal members such as steel posts used in fence building a selected distance into the ground, and particularly to a new and improved post driving machine that is pivotally mounted on the lift mechanism of a farm tractor and maintained in alignment by the post itself throughout substantially all of the driving operation.

BACKGROUND OF THE INVENTION

Modern fence building methods employ large numbers of steel posts in combination with relatively few wooden posts. In some instances steel posts are used exclusively except for corners and/or at gates. However, devices and methods of which applicant is aware for driving steel posts in connection with fence building and other projects leave much to be desired. One method involves standing on the tailgate of a pick-up truck or the like and using a sledge hammer to drive the steel post. This procedure is somewhat dangerous, and the posts are rarely ever driven on the vertical. Another method involves using a tubular piece of pipe closed at its upper end by a weight, positioning the pipe over the top portion of the post, and then reciprocating the pipe by hand to hammer the post into the ground. Some hammers of this type have oppositely disposed handles to allow two persons to operate them. These methods clearly involve a lot of hard work, are slow to implement, and typically result in having a line of steel posts that are not driven vertically into the ground so that the fence has an unsightly appearance unless the posts are bent at the ground to achieve vertical, which can result in weakening the post at the bend.

Various apparatuses have been proposed that briefly store and then release mechanical energy in connection with percussion tools, punches and presses, rock drilling machines, compressors and high pressure pumps. For example U.S. Pat. No. 4,732,220 shows such a device in the form of a hole-punch where a hand crank-operated cam wheel is used to raise and then suddenly release a compression spring-loaded shaft. However, this patent is essentially unrelated to solutions to the problems involved in driving a steel post with a tractor-mounted machine. Indeed, if the patented device were to be mounted on the outer ends of the pivoted draft arms of a tractor, a steel post could not be successfully driven thereby because there is no means to maintain the device in alignment with the post.

A general object of the present invention is to provide a new and improved tractor-mounted steel post driving machine that obviates the above-mentioned difficulties.

Another object of the present invention is to provide a new and improved farm tractor-mounted steel post driving machine having a mast that is automatically aligned with the post throughout the driving operation so that the post can be driven on true vertical.

Still another object of the present invention is to provide a new and improved steel post driving machine of the type described where the mast that carries a reciprocating hammer is maintained in alignment with the post by the post itself as the outer ends of the draft arms on which the mast is mounted are pivoted downward through an arc during the driving operation.

SUMMARY OF THE INVENTION

These and other objects are attained in accordance with the concepts of the present invention through the provision of a machine for driving steel posts and the like into the ground which includes an upstanding mast whose lower end is pivotally mounted on the outer ends of the draft arms of a tractor so as to be lowered and raised thereby. A tubular hammer which is slidably guided on the mast is adapted to telescope over the upper end portion of the post and deliver impact blows thereto as the hammer is raised and then released. A pair of coil power springs whose ends are attached between the mast and to the hammer function to accelerate the hammer downward after the springs have been tensioned and elongated by raising the hammer. A flexible line such as a wire rope cable is attached to the top of the hammer and extends up over a pulley at the top of the mast and then down to a motion converting mechanism which preferably is driven by the power-take-off (PTO) of the tractor. This mechanism functions to convert rotary motion of the PTO to intermittent reciprocating motion of the hammer.

Although the motion converting mechanism can take various forms, a preferred embodiment includes a driving member and a coaxially arranged driven wheel that has the cable attached to a point on its outer periphery. The driven wheel is biased toward the driving member by an adjustable compression spring which causes engagement of respective pairs of cam surfaces on the driving member and the wheel which co-rotatively couple them together throughout a certain angle of joint rotation. During such joint rotation, the cable is reeled in on the driven wheel to raise the hammer and elongate the power springs. However, when the torque forces on the driven wheel which increase as the power springs are progressively elongated, become great enough to overcome the bias of the compression spring, the cam surfaces disengage to allow the driven wheel to quickly counter-rotate relative to the driving member back to substantially its initial orientation as the power springs retract and accelerate the hammer downward to deliver a sharp impact blow to the top of the steel post. The driving member continues to rotate in the same direction and causes the cam surfaces to reengage. The process then repeats to deliver another of a series of impact blow to the top of the post. As the lower end portion of the post is advanced into the ground, the and mast is gradually lowered by manipulation of controls on the tractor.

To maintain longitudinal alignment of the mast with the post as the post is driven into the ground, upper and lower alignment means are employed. The lower alignment means includes structural means on the mast that is engaged by side surfaces of the post as the rear ends of the draft arms on the tractor are pivoted from their raised position to a substantially horizontal position. Such engagement slides the lower end of the mast forward relative to the draft arms to maintain its alignment with the post during the initial part of the driving operation. In combination, a gate member on the mast that is closed against the rear side of the post is engaged by rear side surfaces thereof in order to slide the lower end of the mast rearward as the outer ends of the draft arms are pivoted below horizontal in order to maintain alignment during this portion of the post driving operation.

The upper alignment means includes the hammer which telescopes over the upper end portion of the post, and the means by which it is slidably guided on the mast. To establish initial alignment of the mast and post substantially with the vertical at the beginning of a driving operation, a link is connected between an upper portion of the mast and a bracket on the rear of the tractor. After one or more blows have been struck by the hammer so that the lower end of the post has obtained a purchase with the ground, this link becomes inactive and the telescoping engagement of the hammer with the post maintains the upper end of the mast in alignment. When the lower end of the post has been driven into the ground to a selected depth, the operation of the hammer is stopped and the mast is raised by the draft arm to its full height where the hammer is disengaged from the post. Then the gate member is opened to allow the post to pass out through a rear portion of the machine as the tractor is driven forward.

BRIEF DESCRIPTION OF THE DRAWINGS

The present invention has other objects, features and advantages that will become more clearly apparent in connection with the following detailed description of a preferred embodiment, taken in conjunction with the appended drawings in which:

FIG. 1 is a schematic view of the rear of a tractor having a three-point lift attachment and having the present invention mounted thereon;

FIG. 4 is a side view of the linkage between the upper portion of the mast and the upper attachment point on the tractor;

FIG. 5 is a cross-sectional view, with some parts in elevation, of the motion-converting mechanism of the present invention;

FIG. 6 is a view on lines 6—6 of FIG. 5 showing the driving wheel and its cam lugs and bearing hub;

FIG. 7 is a fragmentary view of a stop means for the driven wheel;

FIGS. 8A-C are fragmentary views showing the operation of a pair of the cam lugs on the driving and driven wheels;

FIG. 9 is a schematic view of an alternative drive shaft arrangement to couple the motion converting mechanism to the PTO of the tractor; and FIG. 10 is a fragmentary cross-sectional view of the steel post between the bar and gate members.

DETAILED DESCRIPTION OF A PREFERRED EMBODIMENT

Figure 2:
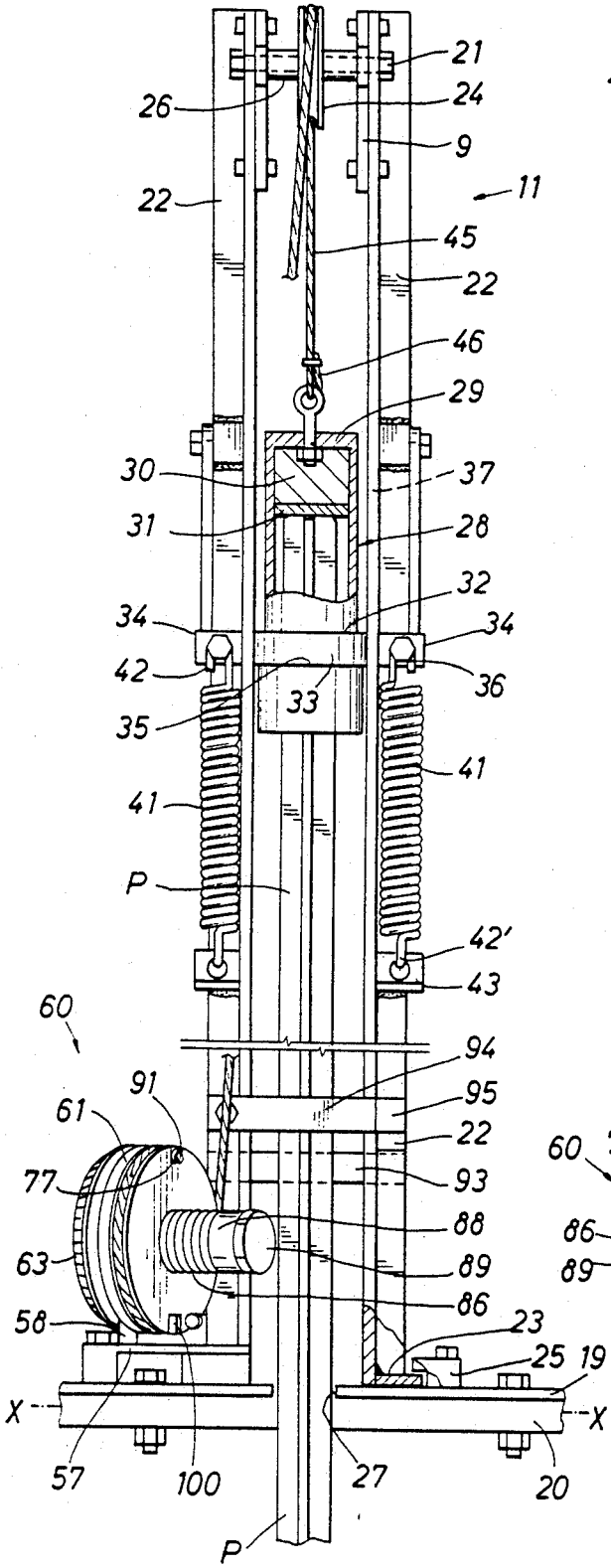
FIG. 2 is a rear elevation of the post driving machine.

Referring initially to FIG. 1, a farm tractor 10 shown from the rear in dotted lines has a steel post driving machine 13 in accordance with the present invention mounted on the outer ends of its draft arms 14. The machine 13 includes an upright mast 11 that carries a hammer assembly 15 by which the steel post P can be driven into the ground. Although other similar attachment means could be used, the tractor 10 is shown as having a three point hook-up system including the pair of laterally spaced draft arms 14 having their front ends pivoted to pins 12 on the lower side of the rear axle housing of the tractor, a pair of control arms 16 having their front ends connected to the outer ends of a transverse shaft whose pivotal rotation is controlled by a hydraulic piston and cylinder system, a pump and a control lever, and a pair of links 17 that are connected between the rear ends of the control arms 16 and approximately the mid-points of the draft arms 14. Although not shown, one of the links 17 can have a hand crank-operated screw mechanism to provide longitudinal adjustment by which the outer ends of the arms 14 can be leveled. An upper bracket and pin connection 18 on the rear of the tractor 10 is used to mount the lower end of a linkage whose structure and function will be discussed in detail below. A draw bar 20 that is connected between the outer ends of the arms 14 can be used to carry the driving machine 13. A base plate 19 for the mast 11 of the machine 13 is bolted on top of the draw bar 20, and a motion converting mechanism 60 also is mounted on the top side of the base plate toward the rear thereof. A cable 45 extends from the mechanism 60 up over a pulley 24 at the top of the mast 11 and then down to a hammer assembly 15 that applies intermittent impact blows to the top of the steel post P. Thus the entire machine 13 is mounted between the outer ends of the draft arms 14, and can be moved upward and downward through operation of the above-mentioned hydraulic system via the control lever on the tractor 10. The general arm and hook-up arrangement described above is one that is typically found on numerous makes and sizes of farm tractors.

Turning now to FIG. 2, the mast 11 has a pair of spaced-apart legs 22 made of angle iron or the like, the lower ends of which are provided with enlarged feet 23 that are slidably mounted in elongated guides 25 which are bolted or otherwise secured to the base plate 19. If desired, the lower surface of the feet 23 can be provided with rollers (not shown) which permit substantially friction-free fore and aft relative movement. The guides 25 provide stops 25' at each end to limit the extent of forward and rearward movement of the feet 23. The back portion of the base plate 19 extends rearward of the draw bar 20 as shown, and a longitudinally extending slot 27 is formed in such rear portion and extends from the rear edge thereof to a point between the lower ends of the legs 22 adjacent the rear edge of the draw bar 20. The slot 27 is slightly wider than the steel post P that will extend down through the slot as the post is driven.

The pulley 24 is mounted on brackets 9 at the upper ends of the legs 22 by a suitable shaft 21 and spacers 26. A small diameter roller 27 can be fixed to the legs 22 below the pulley 24, and the cable passed main and thereof, so that the downward reach of the cable below the roller is substantially aligned with the longitudinal centerline Y of the mast 11.

Figure 3:
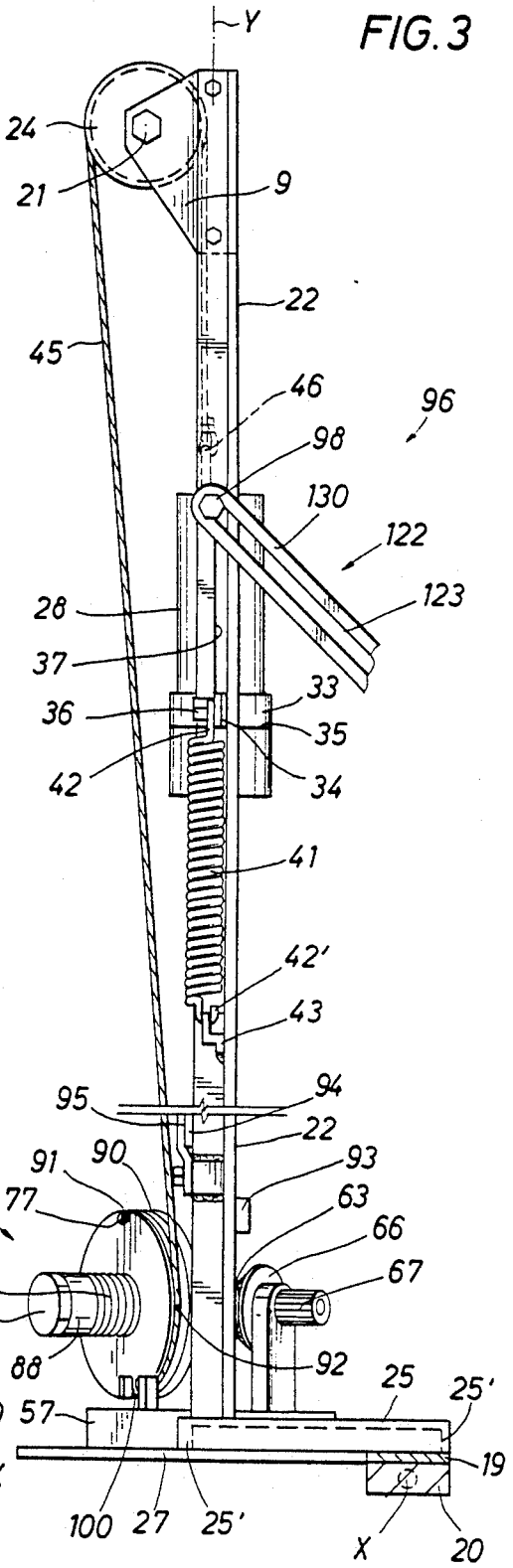
FIG. 3 is a side elevational views of the structure shown in FIG. 2.

The hammer assembly 15 includes a tubular member 28 which is suspended between the legs 22 and attached by suitable means to the outer end of the cable 45. The upper end of the hammer 28 is closed by a wall 29, and a slug of heavy material 30 such as lead preferably is located in the upper portion of the bore of the hammer 28 to increase the weight thereof. A steel disc 31 is positioned at the bottom of the lead slug 30 to provide a rigid impact surface that engages the top of the steel post P when the hammer 28 is raised and then accelerated downward. The hammer 28 is guided during upward and downward movement on the mast 11 by means such as a clamp assembly 32 that is mounted around the hammer as shown in FIGS. 2 and 3A. The clamp assembly 32 includes a pair of straps, each of which has a semi-circular mid-portion 33, and flat, outwardly extending arm portions 34. The lower edges of the portions 33 preferably engage an upwardly facing shoulder 35 on the exterior of the hammer 28. The arms 34 extend outward through elongated slots 37 (FIG. 3) in the inner sides of the respective legs 22 and are attached together by bolts 36 or the like. The heads of the bolts 36 are attached to the tangs 42 on the respective upper ends of a pair of coiled power springs 41. The tangs 42' at the lower ends of the springs 41 are attached to ears 43 that are fixed by suitable means such as welding to lower portions of the legs 22. The inner end of the cable 45 extends downward to a motion-converting mechanism indicated generally at 60 that preferably is mounted somewhat to the side of the mast 11 and toward the rear of the base plate 19. The mechanism 60 functions to convert rotary motion of the PTO shaft of the tractor 10 to intermittent reciprocating motion of the hammer 28.

As shown in FIG. 5, the motion-converter mechanism 60 includes a driving wheel 61 that is splined at 59 to a shaft 62 which has a large diameter gear 63 on its outer end. The shaft 62 is journaled for rotation in a bearing 64 that is fixed in a wall 58 on a mounting plate 57 which is bolted or otherwise secured to the base plate 19. The gear 63 meshes with a small diameter pinion 66 on the rear end of a splined shaft 67 that is driven by the PTO of the tractor 10 via a suitable telescoping drive shaft (not shown) having universal joints and splined sleeves at each end. If desired, the gears 63 and 66 can be enclosed in a housing which contains a suitable level of lubricating oil. The ratio of the number of teeth of the gears 63, 66 provides an appropriate speed reduction so that the gear 63 and the shaft 62 turn relatively slowly. As shown in FIG. 6, the outer side surface of the driving wheel 61 has a pair of diametrically opposed, arcuate cam lugs 75 formed thereon which are spaced at equal radial distances from the center of the wheel 61. Each cam lug 75 has the general overall shape of a wedge, and has an outer surface 69 that inclines from a leading edge 70 (assuming rotation in the direction of the arrow D) at the level of the wheel's outer wall surface 71, to a trailing edge 72 that is located outward of the edge 70. The transition between of the outer wall surface 69 and the end wall of the lug 75 preferably is rounded at 73 as shown more clearly in FIG. 8A. The central annular portion of the wheel 61 can be thickened to provide an annular bearing hub 74 that is slightly thicker than one-half the maximum height of each cam lug 75.

A driven wheel 77, which is not splined to the shaft 62 and thus is free to rotate relative thereto, has an identically shaped pair of cam lugs 78 as shown in FIG. 8A that are oppositely oriented so that their leading edges 80 are located at the inner ends of their inclined surfaces 81 and blend into the outer surface 83 of the wheel 77. Their trailing edges 82 are located outwardly of the edges 80, and the transition between the trailing edges and the end surfaces of the lugs 78 are rounded to the same shape as the surfaces 73. Like the driving wheel 61, the driven wheel 77 has a raised bearing hub 84 with a thickness that is slightly greater than one-half the height of the lugs 78, and which engages the opposed bearing hub 74 on the wheel 61 so long as relative sliding movements of the pairs of cam lugs 75 and 78 have not forced the wheel 77 axially away from the wheel 61. It will be recognized that the cam lugs 75, 78 can be made much wider than shown in FIG. 6, and could extend from near the outer peripheral edges of the wheels to the outer peripheral walls of the bearing hubs 75, 84. When the lugs 75, 78 first engage as shown in FIG. 8A, or have released as shown in FIG. 8C, the outer ends of the ramp surfaces 81, 69 do not engage the opposed wall surfaces of the wheels 61, 77. Instead, the opposed wall surfaces of the bearing hubs 74, 84 come together to provide a large area of bearing contact that reduces wear. Of course when the lugs 75, 78 are sliding relative to one another as shown in FIG. 8B, the wheel 77 is being shifted axially away from the wheel 61, which temporarily separates the opposed wall surfaces of the hubs 74, 84.

To provide a yieldable resistance to outward shifting of the wheel 77, and thus to disengagement of the cam lugs 75, 78, so that the hammer 28 moves up a selected distance before release occurs, a coil spring 86 (FIG. 5) surrounds the shaft 62 and reacts between the outer side of the driven wheel 77, preferably via a roller bearing 87, and a sleeve 88 that is axially slidable on the outer end of the shaft 62. The sleeve 88 can be slidably mounted in a bearing on a wall 79 of the mounting plate 57 to stabilize the rotation of the outer end of the shaft 62. Means such as a stud 89 which is threaded into the end of the shaft 62 can be adjusted in and out by a suitable wrench to vary the compression of the coil spring 86. Preferably the coil spring 86 initially is compressed or foreshortened a selected amount to provide an inward bias or preload force that prevents any relative sliding of the cam lugs 75, 78 until such force is overbalanced by outward torque force due to tension in the cable 45.

As shown in FIG. 3, the cable 45 passes from the pulley 24 down to the driven wheel 77 where it engages at point 92 in a groove 90 and then passes around the circumference of the wheel to an anchor point 91 that can be located about 270° from the point 92, although a lesser angle greater than 90° could be employed. At the point 91, the end of the cable 34 can be anchored in numerous ways, for example by passing the end portion of the cable 45 out through a notch in the side of the groove 90 and then knotting such end portion. Of course the cable 45 can be reaved around the groove 90 several times before its end is anchored at point 91.

The resistance to elongation of the power springs 41, together with a stop assembly to be described below, hold the driven wheel 77 in an initial angular orientation until the cam lugs 75 on the driving wheel 61 come around and engage the cam lugs 78. Then the wheel 77 will be driven in rotation with the driving wheel 61 through a predetermined acute angle that depends upon the bias of the coil spring 85 which is set by the initial preload compression thereof, and its rate joint rotation of the wheels 61 and 77 reels in the cable 45 and raises the hammer 28 by a distance that is a function of the diameter of the driven wheel 77 and the angle of joint rotation, thereby elongating the power springs 41 and storing potential energy therein. When the inward force of the spring 86 is overbalanced by axial outward force exerted by the cam lugs 78 on the cam lugs 75, the ramp surfaces 69 and 81 will begin to slide relative to one another as shown in FIG. 7B. The outward movement of the wheel 77 due to such relative sliding foreshortens the spring 86 and separates the hubs 70, 84. At a predetermined angle of joint rotation of the wheels 61, 77, which determines the amount the hammer 28 is lifted, for example about 80°, the cam lugs 78 suddenly slide completely past the cam lugs 75 as shown in FIG. 8C, which allows the bearing hubs 70, 84 to come back together and the driven wheel 77 to quickly counter-rotate to approximately its initial angular orientation as the power springs 41 contract and accelerate the hammer 28 downward. The rounded transition surfaces 73 prevent abrupt disengagement of the cam lugs 75, 78. As the driving wheel 61 continues its rotation in the direction of the arrow D in FIG. 6, its cam lugs 75 will revolve around and again pick up the lugs 78 on the driven wheel 77 and cause joint rotation to again lift the hammer 28 and elongate the power springs 41 by a selected amount. The process repeats on a regular basis to deliver a series of intermittent impact blows to the top of the steel post P. As the post P is advanced into the ground, the outer ends of the draft arms 14, and thus the mast 11, are gradually lowered by the operator, preferably so as to maintain slight tension in the power springs 41 when the hammer 28 is at the bottom of its stroke. Due to the intermittent nature of the motion, there is ample time to effect such lowering before the hammer 28 begins to more upward again.

To prevent excessive counter-rotation of the driven wheel 77 after the hammer 28 strikes the top of the post P, which could result in objectionable slack in the cable 45, various means can be used. For example, as shown in FIG. 7 a stop can be provided in the form of a radial shoulder 101 on the outer side of the driven wheel 77 opposite one of the cam lugs 75, which is aligned to engage a stop assembly 102 that is fixed to the mounting member 57. The stop assembly 102 can include a plunger 100 having a head 103 and a stem 107 that is mounted in a bracket 104 which is fixed by suitable means to the mounting member 57. An elastomer ring 105 provides a cushion against rearward movement of the plunger head 103, and its forward movement is limited by a key 106 or the like. The stop assembly 102 preferably is positioned to allow a limited degree of overtravel of the wheel 77 beyond its initial orientation, in the range of from 5°-10°, before the shoulder 101 encounters the head 103 of the plunger 100. Such limited overtravel allows the hammer 28 to strike the top of the post P with maximum momentum, and accommodates for any stretch in the cable 25 under tension. In the stop position, the power springs 41 hold the shoulder 101 and the head 103 together to prevent any substantial rebound rotation. Of course the shoulder 101 will abut the plunger head 103 at a point in time well prior to the time the cam lugs 75 on the driving wheel 61 come around and again pick up the cam lugs 78 on the driven wheel 77 to initiate another cycle.

It will be recognized that as the machine 13 is lowered as the post P is driven, the draw bar 20 and the base plate 19 move in an arc by reason of their mounting on the outer ends of the draft arms 14 which are pivoted to the tractor 10 at the pins 12. In order to maintain the mast 11 in alignment with the steel post P during driving, upper and lower alignment means in accordance with the present invention are employed. The lower alignment means includes a structural member 93 (FIG. 2) in the form of a bar that is attached to extend between the front sides of the legs 22 near the lower ends thereof, and a gate member 94 that is pivoted to the rear side of one of the legs 22. The gate member 94 is opened to allow the steel post P to be positioned through the slot 27 and against the bar member 93, after which the gate member is closed so that its free end is captured in a retainer 95. As shown generally in FIG. 10, most all steel posts have a T-shaped cross-section. One common construction has a wide section 135 with a smooth rear surface 136 that is about 1.75 inches wide, and a leg 137 that has vertically spaced recessed (one shown in phantom lines) which receive fence wires and prevent vertical slippage when tied. The front-to-rear dimension of this post is about 1.25 inches, including the depths of the recesses. In another type construction, the front leg 137 has a smooth outer edge, and a relatively short rear leg 137' is provided which has the vertically spaced recesses. Either type of post can be oriented between the legs 22 of the mast 11 such that either the smooth rear surface of that type, or the outer edge of the short leg 137' of the other type, is against the bar member 93. Both the bar number 93 and the gate member 94 should have a height such that it spans several adjacent wire-receiving recesses on an outer edge of a post P in case the tractor 10 is at a right angle to the fence line. Alternatively the post P can be oriented such that these surfaces face one of the legs 22, depending upon which side of the post the fence wire is to be attached. A small metal block 130 which can be releasably fixed to the bar 93 by a screw 131 can be used to provide support one or more of the legs of the post, including the leg which has the wire recesses, so that there is substantially a full side surface engagement with the post as it is driven. When the post is oriented, the tractor 10 can be driven straight ahead along the fence line to the next post location once a driving operation is completed. The upper end section of either type of post will fit within a 2" i.d. hammer 28 with sufficient radial clearance for unrestricted telescoping movement.

Assuming that the post driving operation is commenced with the draw bar 20 near its uppermost position, and is continued until the bar is somewhere below the mid-point of its arc, during the upper portion of the arc of movement the back side of the post P, or one of its side edges, depending upon orientation, will engage the cross-bar 93 and force the feet 23 on the lower ends of the legs 22 of the mast 11 to slide forward in the guides 25. Such forward sliding maintains the lower portion of the mast in alignment with the lower portion of the post P. During the lower portion of the arc of movement of the draw bar 20 and the base plate 19, the front edges of the projections on the post P, or one of its side edges, depending upon orientation, will engage the gate member 94 and force the feet 23 and thus the lower end of the mast 11 to slide rearward in the guides 25 to maintain such alignment throughout.

The upper alignment means includes the hammer 28, its inner bore surfaces, and the arms and slots 34, 37 by which it is slidably guided on the mast 11. At all times during the driving operation, the upper end portion of the post P is confined within the bore of the hammer 28 so that the upper portion of the mast 11 will remain in alignment with the post. In order to provide initial alignment of the mast 11 and the post P in the vertical as the post is first started into the ground, a link 120 shown in FIGS. 3 and 4 is provided. The link 120 includes a rod 121 having a yoke-shaped clevis assembly 122 threaded at 128 to its upper end. The clevis assembly 122 includes a ball and socket swivel arrangement 129 between its upper and lower portions to allow a degree of misalignment between the rod 121 and the upper portion 130 of the clevis 122 for purposes to be explained below. The opposite arms of the clevis portion 130 have elongated slots 123 that receive bolts 98 on the opposite sides of the mast legs 22. The lower end of the rod 121 is attached to a swivel coupling 124 that is connected to the standard upper attachment bracket assembly 18 on the tractor 10 by a pin 125. The overall length of the link 120 between the axis of the pin 125 and the outer end surfaces 126 of the slots 123 is such that when the hammer 28 initially is positioned over the top portion of the post P and the impact disc 31 is engaging its top surface, and when the bottom end of the post is resting on the ground, the mast 11 and the post P are in the vertical. This length can be adjusted, if need be, to attain the vertical by changing the amount the clevis assembly 122 is screwed onto the threads 128. After one or two blows have been struck with the hammer 28, the bottom end of the post P will have obtained sufficient purchase with the ground that the mast 11 is thereafter maintained in alignment by engagement of the post first with the cross-bar 93 and then the gate member 94, in addition to the guidance that is provided by the internal bore walls of the hammer 28. As the mast 11 moves downward relative to the attachment bracket 18 on the tractor 10, the bolts 98 simply slide downward in the slots 123 so that the link 120 becomes essentially inactive. The combined weights of the motion-converting mechanism 60, the mast 11 and the base plate 19, which are centered to the rear of the axis X of the draw bar 20 as shown in FIG. 3, cause the top of the mast 11 to have a tendency to tilt rearward so that initially the bolts 98 will engage the outer ends 126 of the slots 123. This feature also keeps the mast 11 in an essentially vertical position anytime the mast is raised and a post is not being driven.

Rather than powering the input shaft 67 of the motion converting mechanism 60 by a drive shaft assembly that extends directly thereto from the PTO 6 of the tractor 10 as shown in FIG. 3, a drive shaft arrangement shown schematically in FIG. 11 can be used. The shaft 67' is arranged vertically and couples the pinion 66 which drives the gear 63 to a bevel gear 140 mounted below the base plate 19, the shaft being mounted in a suitable bearing assembly 191. The gear 140 meshes with a gear 142 on the rear of a shaft 143 which has its rear portion journaled for rotation in a bearing 144 that is attached to the base plate 19, and its forward portion journaled for rotation in a bearing 145 that is attached to the lower side of the draw bar 20. The front portion of the shaft 193 is provided with splines 146 by which it can be rotatably coupled to the rear splined sleeve 147 of a U-joint drive assembly 148. The assembly 148 is on the outer end of a telescoping shaft assembly 149 having a slidably splined connection as shown, and which is coupled by another U-joint and splined sleeve (not shown) to the splined PTO shaft of the tractor. The location of the input shaft 143 just below the level of the draw bar 20 reduces the angle between the rotation axis of the telescoping shaft assembly 149 and the rotation axis of the PTO 6, particularly when the mast 11 is in the raised position at the beginning of a post driving operation. Such angle reduction minimizes vibrations that can occur at severe angles, and provides a design compromise between the angles that necessarily exist at the uppermost and lowermost positions of the mast 11.

Rather than being mounted on the base plate 19, the motion-converter mechanism 60 can be mounted on a separate platform that is fixed to the lower ends of the legs 22 just above the feet 23. Such an arrangement will prevent any changes in the angle of the outer reach of the cable 24 below the pulley 24 as the mast 11 shifts forward and then rearward during a post driving operation, and is within the scope of the present invention.

OPERATION

In operation, the various components of the machine 13 are assembled as shown in the drawings, and the base plate 19 can be mounted on the draw bar 20 by bolts as shown. Alternatively the base plate 19 can itself be made with an outwardly projecting pin on each side in order to pivotally attach the plate to the outer ends of the draft arms 14 for pivotal rotation about the axis X in FIGS. 2 and 3. The linkage 120 is connected between the bolts 98 near the upper end of the mast 11 and the attachment bracket 18 on the tractor 10 to keep the mast substantially upright. The motion converting unit 60, which preferably is mounted in a skewed position on the base plate 19 near the bottom and slightly to the rear of the mast 21 as shown in FIG. 2, is coupled to the PTO shaft 6 of the tractor 10 by a conventional telescoping shaft, U-joint and splined sleeve assembly, or by the drive shaft arrangement shown in FIG. 10.

To perform a post driving operation, the draw bar 20 and the mast 11 are raised to maximum height, and the post P is positioned through the slot 27 and into alignment in the mast 11 with the lower end of the post resting on the ground. The upper end portion of the post P is aligned for engagement in the bore of the hammer 28 and the post is oriented with respect to the cross-member 93 as discussed above. Then the gate member 94 is closed. If not already so positioned, the lower end of the mast 11 should be pulled rearward to the maximum amount allowed by engagement of the feet 33 with the rear stops 25' on the guides 25. Then the mast 11 is lowered by using the control lever on the tractor 110 until the upper end portion of the post P is engaged within the bore of the hammer 28 and the top surface of the post P is up against the impact disc 31. Preferably the mast 11 is lowered a short additional amount, so that with the bottom end surface of the post on the ground, the power springs 41 are under low tension. During such initial lowering, the top of the mast 11 will be tilted rearward slightly to achieve alignment with the vertical. If desired, the post P can be positioned initially with its upper portion within the bore of the hammer 28, and gate member 94 provided with a bow spring or the like which frictionally engages outer edges of the post P to maintain it in this position during initial lowering, that is, until the lower end of the post rests on the ground.

The PTO 6 then is placed in operation to cause the driving wheel 61 to begin to rotate. When its cam lugs 75 engage the cam lugs 78 on the driven wheel 77, the driven wheel rotates with the wheel 61 through a predetermined angle having a maximum of about 90°, which causes the cable 45 to raise the hammer 28 and lengthen the power springs 41 to store potential energy therein. When the tension force in the cable 25 produces resultant forces that are sufficient to foreshorten the adjustment spring 86 enough to allow the lugs 75, 78 to slide past one another as shown in FIG. 8C, the power springs 41 are suddenly free to contract and accelerate the hammer 28 downward to cause the disc 31 to impact the top of the post P. As the springs 41 force the hammer 28 downward, the driven wheel 77 counter-rotates relative to the wheel 61 until the limit shoulder 101 engages the stop assembly 102, where the driven wheel is held momentarily by resistance to elongation of the power springs 41. The cam lugs 75 on the driving wheel 61 come around and again engage the cam lugs 78 on the wheel 77. The process then repeats to intermittently raise and then release the hammer 28 in order to subject the top surface of the post P to repeated impact blows. In a typical example, a six foot long steel post should be driven into the ground about 18 inches, leaving four and one-half feet of the post exposed above ground level for attaching fence materials thereto. Longer or shorter steel posts can be driven with different height masts 11.

As the steel post P is advanced into the ground by successive blows, the machine 13 is lowered in appropriate increments by manipulation of the hydraulic control lever on the tractor 10 in a manner such that low tension is placed in the springs 41 each time the hammer 28 is in its down position. The condition of the springs 41 can be readily observed by the operator. Although the base plate 19, the outer ends of the arms 14, and the motion converter 60 move in an arc about the pivot pins 12 on the tractor 10, the front side or edge of the post P engages the cross-bar 93 during the initial part of such lowering to cause forward sliding of the feet 23 of the legs 22 in the guide 25, which maintains the lower part of the mast 11 in alignment therewith until the draft arms 14 are substantially horizontal. Below that, a rear edge of the post P engages the gate member 94 to cause rearward sliding of the feet 23 to maintain such alignment throughout. The link 120 provides initial vertical alignment of the top of the mast 11 as previously described, and then the hammer 28 and its guide arms 34, which work in the slots 37, maintain alignment of the top of the mast 11 with the post P during the balance of the driving operation. When the bottom of the steel post P has been driven a suitable distance into the ground, the outer ends of the draft arms 14, and the machine 13 will be somewhat below the mid-point of their downward travel. The PTO 6 of the tractor 10 then is disengaged to stop the operation of the hammer 28. The machine 13 then is raised to its full height, during which the hammer 28 is automatically removed from the top portion of the post P. The gate member 94 is then opened, and as the tractor 10 is driven forward the slot 27 in the base plate 19 allows the post P to pass outwardly through the rear thereof.

The preload of the coil spring 86 can be adjusted by turning the stud 89 to provide different distances of upward movement of the hammer 28 before the cam lugs 75, 78 disengage. Thus the momentum of the hammer 28 when it strikes the top of the steel post P can be varied to accommodate different soil conditions where the post is being driven. For example in dry, hard clay soil the momentum can be maximized by adjusting release to occur near 90° of joint rotation of the wheels 66 and 71, whereas in sandy loam a lesser momentum may be desirable so that release is set to occur at some angle substantially less than about 90°. As a safety measure, the cam lugs 75, 78 on the converter unit 60 must release when the hammer 28 has traveled upward far enough for the guide arms 34 to engage to top surfaces of the slots 37. Thus overtravel of the hammer 28, to the extent that it might otherwise disengage from the top of the post P, is not possible.

Since the machine 13 is mounted entirely on the lift mechanism of the tractor 10, a post P can be driven vertically on inclined terrain by adjusting the overall length of one of the links 17 that connect the control arms 16 to the draft arms 14. For example if the ground surface shown in FIG. 1 is visualized as sloping downward from the right to the left, the link 17 can be lengthened until the mast 11 is vertical before the driving operation is commenced. The position of the clevis 122 on the upper end of the rod 121 can be adjusted by unthreading 128 so that the mast 11 is vertical in a fore-and-aft plane at the beginning of the operation. The ball socket 127 allows misalignment of the clevis 122 with the rod 121 under conditions where the top of the mast 11 is tilted to the right or to the left to achieve vertical.

The motion converting mechanism 60 has been shown as being mounted to the rear and to one side of the mast 11, and with the shaft 22 being skewed somewhat so that the point 90 where the cable 45 first touches the groove 88 on the pulley 24 is as near to the centerline Y as is practically possible, while allowing clearance for the post to move in and out of the slot 27. This construction reduces to a minimum side loads on the mast 11 that result from tension in the cable 24. The skew of the shaft 62 also allows optimum alignment of the drive shaft with the PTO 6 of the tractor 10 throughout the vertical travel of the assembly to minimize vibrations, particularly at the highest and lowest positions. Although the mechanism 60 could be mounted in front of the mast 11, the arrangement shown is preferred to reduce angular offsets and allow proper drive shaft operation. Such vibrations can be further reduced through use of the drive shaft arrangement shown in FIG. 10. Of course the motion coverter 60 could be driven by an auxiliary engine mounted to the side of the base plate 19.

At the maximum height to which the mast 11 is lifted by the draft arms 14, the top of the mast will be tilted slightly forward by the link 121. However, as mentioned above the weights of the converter unit 60 and the base plate 19 are centered to the rear of the pivot axis X of the draw bar 20 so that the bolts 98 will remain against the rear surfaces 126 of the slots 123 in the clevis 122 until the driving of the post P has commenced.

If desired, a typical sliding sleeve clutch (not shown) can be positioned between the input shaft 67 and the gear 66 which drives the converter mechanism 60 as shown in FIG. 3, or between the gear 98 and the input splines 103 as shown in FIG. 10. The clutch would be engaged and disengaged by a typical yoke and lever mechanism that is attached to an operating rod which is accessible to the operator. Disengagement of the clutch would allow operating the lifting arms 14 to raise and lower the machine 13 without operating the converter mechanism 60 and the hammer 28, where the tractor 10 is of a design that joint operation of the draft arms and PTO normally occurs.

It now will be recognized that a new and improved steel post driving machine has been disclosed which meets all the objectives and has all the features and advantages set forth above. Since certain changes or modifications may be made in the disclosed embodiment without departing from the inventive concepts involved, it is the aim of the appended claims to cover all such changes and modifications falling within the true spirit and scope of the present invention.

What is claimed is:

1. A machine adapted for use in driving a steel post, said machine being mounted on rear ends of pivotally arranged draft arms of a farm tractor, comprising: an upright mast carrying reciprocating hammer means for delivering repeated impact blows to the top of the steel post; means for reciprocating said hammer means; and cooperable means on said post and said mast for causing said post to maintain said mast in substantially vertical alignment therewith as said rear ends of said draft arms are lowered and pivoted downward during the driving operation, wherein said cooperable means includes guide means enabling a lower end of said mast to slide forward and rearward in a longitudinal direction as said rear ends of said draft arms are pivoted downward.

2. The machine of claim 1 wherein said cooperable means further includes structural means on a lower portion of said mast that are engaged by said post during driving to cause the lower end of said mast to slide relatively forward during an initial part of said lowering and to cause said lower end to slide relatively rearward during a subsequent part of said lowering.

3. The machine of claim 2 wherein said structural means includes a member on said mast that is engaged by surfaces of said post during said initial part of said lowering.

4. The machine of claim 2 wherein said structural means includes gate means on said mast that is engaged by surfaces of said post during said subsequent part of said lowering.

5. The machine of claim 1 wherein said cooperable means includes said hammer means; and means for slidably guiding said hammer means during reciprocating movement on said mast.

6. The machine of claim 5 further including link means connected between an upper portion of said mast and the farm tractor for providing initial alignment of said mast with substantially the vertical when said machine is in a raised position.

7. The machine of claim 6 wherein said link means includes an upper section having elongated slot means formed therein; and attachment means on said mast engageable in said slot means for limiting pivotal movement of said upper portion of said mast.

8. The machine of claim 7 further including means allowing misalignment of said upper section of said link means with a lower portion thereof when said post is being driven vertically into sloping terrain.

9. The machine of claim 1 further including power spring means for yieldably resisting upward movement of said hammer means; and motion converting means for raising said hammer means to thereby lengthen said power spring means and store potential energy therein, and for then releasing said hammer means to enable said power spring means to retract and accelerate said hammer means downward against a top of said steel post.

10. The machine of claim 9 wherein said motion converting means includes rotatable driving and driven members; means connecting said driven member to said hammer means; and releasable cam means on said members for causing joint rotation thereof until said power spring means have been extended by a certain amount, said cam means then being released to allow counter-rotation of said driven member and downward movement of said hammer means.

11. The machine of claim 10 further including stop means for limiting the angle of counter-rotation of said driven member.

12. The machine of claim 11 wherein said stop means is positioned to allow a small degree of over-rotation of said driven member.

13. The machine of claim 10 further including adjustable means for resisting release of said cam means with a selected force.

14. The machine of claim 13 wherein said adjustable means includes a compression spring arranged to apply axial force which resists release of said cam means; and means for adjusting the compression of said spring to change the magnitude of said axial force.

15. The machine of claim 10 wherein said cam means comprises cooperating pairs of arcuate lugs on said members and defining opposed ramp surfaces that engage one another during joint rotation of said members and which are released from one another to permit said counter-rotation.

16. The machine of claim 15 wherein said ramp surfaces have a maximum height, and wherein each of said members have bearing surface means with an axial thickness that is greater than one-half said maximum height of said ramp surfaces to prevent engagement of said ramp surfaces with opposing walls of said respective members during said counter-rotation.

17. The apparatus of claim 16 wherein said ramp surfaces have outer end portions which are rounded to prevent abrupt disengagement thereof.

18. The machine of claim 1 further including base means for mounting said mast on said rear ends of said draft arms, said base means extending rearward beyond said outer ends of said arms and having a rear edge; and longitudinally extending slot means in said base means and opening through said rear edge for receiving said steel post during driving thereof and for allowing disengagement of said machine therefrom when driving is completed.

19. A mechanism for use in delivering intermittent impact blows to an elongated slender object being driven into the ground, comprising: a first rotatable member coupled to a shaft; a second member rotatable relative to said shaft and said first member, means intermittently coupling said second member to said first member for joint rotation throughout a predetermined angle and for then releasing said second member for counter-rotation to substantially its initial rotational position; means connected to said second member for causing an impact device to move in one direction during said joint rotation and for allowing said impact device to move in the opposite direction during said counter-rotation, said releasing occurring when a predetermined counter-torque is applied to said second member; and variable means for adjusting the counter-torque at which said releasing occurs.

20. The mechanism of claim 19 wherein said coupling means includes oppositely inclined ramp surface means on said members that are engaged during said joint rotation, said ramp surface means sliding relative to one another to cause said second member to move axially away from said first member and disengagement of said ramp surface means to allow said counter-rotation of said second member.

21. The mechanism of claim 20 wherein said variable means includes compression spring means opposing axial movement of said second member away from said first member; and means for adjusting the compression of said spring means to determine the counter-torque at which release occurs.

22. The mechanism of claim 19 further including means for stopping counter-rotation of said second member at substantially its initial position.

23. The mechanism of claim 22 further including annular bearing surfaces on said members that engage each other during said joint rotation and said counter-rotation, said bearing surfaces being disengaged in response to relative sliding movement of said ramp surface means.

24. The mechanism of claim 19 wherein said means connected to said second member is a cable having an end portion reaved at least partially around the periphery of said second member and attached thereto at a point that is at least 90° from the point where said means initially engages said periphery after said counter-rotation.

25. A method for driving a lower portion of a steel post into the ground with a machine that is adapted to be mounted on the rear ends of pivotally arranged draft arms included in a lift mechanism of a farm tractor, comprising the steps of: mounting an upright mast and impact means on said mast for driving the lower portion of said steel post into the ground, operating the lift mechanism to raise said mast and impact means to a height that enables a top portion of the post to be positioned within said impact means; reciprocating said impact means while lowering said mast by operation of said lift mechanism to drive the said lower portion of said steel post into the ground; and using said post to maintain said mast in substantially vertical alignment therewith throughout the driving operation as said rear ends of said draft arms are lowered and pivoted downward during the driving operation, wherein said using step is carried out in part by engaging said post with a lower portion of said mast to cause said lower portion to slide forward and rearward with respect to said lift mechanism.

26. The method of claim 25 wherein said using step is carried out in part by engaging said impact means with said top portion of said post to cause an upper end of said mast to remain in alignment therewith.

27. The method of claim 26 including the further step of providing linkage means that is connected between said tractor and an upper portion of said mast to establish an initial alignment of said mast with the vertical.

28. A method of driving a steel post a selected distance into the ground with a tubular hammer that is mounted for reciprocating movement on a mast having a lower end carried for sliding movement on outer ends of pivotally arranged draft arms of a farm tractor, comprising the steps of: using said arms to raise said mast to an upper position; positioning a steel post in alignment with said mast and inserting an upper end portion of said post within a bore of said hammer; lowering said mast to position a bottom end of said post on the ground; operating said hammer to deliver repeated impact blows to a top of said post and thereby advance a lower end thereof into the ground; lowering the outer ends of said arms and said mast as said post is driven; engaging front surfaces of said post with one structural member on said mast as said arms are being pivoted to substantially a horizontal position in order to slide the lower end of said mast forward and thereby maintain said lower end of said mast in alignment with said post; engaging rear surfaces of said post with another structural member on said mast as said arms are pivoted below said horizontal position in order to slide the lower end of said mast rearward and thereby maintain said lower end of said mast in alignment with said post and using the engagement of said upper end portion of said post with said tubular hammer to maintain an upper end of said mast in alignment with said post throughout said pivotal movement of said arms.

29. The method of claim 28 including the further step of connecting a link between the tractor and an upper portion of said mast which provides initial alignment of said mast with substantially the vertical in the raised upper position of said mast; and disabling said link after said lower end of said post has been started into the ground.

30. The method of claim 29 including the additional step of adjusting the overall length of said link to achieve alignment of said mast when the post is driven vertically on sloping terrain.

* * * * *